United States Patent [19]

Mitter

[11] 4,417,515

[45] Nov. 29, 1983

[54] LATERAL SUPPORT FOR SQUEEGEE

[76] Inventor: Mathias Mitter, Falkenstr. 57, 4815 Schloss Holte, Fed. Rep. of Germany

[21] Appl. No.: 294,165

[22] Filed: Aug. 19, 1981

[30] Foreign Application Priority Data

Aug. 28, 1980 [DE] Fed. Rep. of Germany ..... 3032345

[51] Int. Cl.[3] ..... B41L 13/06

[52] U.S. Cl. ..... 101/120; 24/522; 248/639; 269/270; 384/205; 384/257

[58] Field of Search ..... 101/116–124, 101/126, 127, 128.1; 24/263 R, 263 SB; 269/208, 156, 268, 270, 287, 47, 50, 51; 308/31, 32, 74, 161; 83/456; 248/639; 279/111, 110, 76

[56] References Cited

U.S. PATENT DOCUMENTS

| | | | |
|---|---|---|---|
| 337,884 | 3/1886 | Stigler | 308/32 |
| 373,071 | 11/1887 | Humphrey | 308/32 |
| 552,299 | 12/1895 | McLachlan | 308/74 |
| 596,280 | 12/1897 | Short | 308/244 |
| 606,878 | 7/1898 | Rouse | 101/120 |
| 628,651 | 7/1899 | Cummings | 101/120 |
| 932,600 | 8/1909 | Burdick | 101/119 |
| 1,036,202 | 8/1912 | Elliott | 101/120 |
| 1,893,699 | 1/1933 | Dunning | 248/639 |
| 2,180,135 | 11/1939 | Bartholomew | 101/119 |
| 3,216,349 | 11/1965 | Kraft | 101/120 |
| 3,901,146 | 8/1975 | Stierlein | 101/119 |
| 4,023,487 | 5/1977 | Mitter | 101/120 |
| 4,055,119 | 10/1977 | Mitter | 101/120 |

FOREIGN PATENT DOCUMENTS

| | | | |
|---|---|---|---|
| 608654 | 1/1935 | Fed. Rep. of Germany | 248/656 |
| 2629965 | 2/1977 | Fed. Rep. of Germany | 101/120 |
| 546145 | 2/1974 | Switzerland | 101/127.1 |
| 1378317 | 12/1974 | United Kingdom | 101/120 |

*Primary Examiner*—Clyde I. Coughenour
*Attorney, Agent, or Firm*—Michael J. Striker

[57] ABSTRACT

A lateral support for a squeegee of an application mechanism of an application machine, has a supporting element arranged to support one end portion of a squeegee, and at least one substantially upright upwardly open guiding element arranged to slidingly guide the supporting element. The supporting element can be guided in or on the guiding element. An application mechanism of an application machine has perhaps a rotary stencil, a squeegee perhaps inside the rotary stencil, and a lateral support including a supporting element and an upwardly open guiding element arranged to slidingly guide the supporting element.

29 Claims, 6 Drawing Figures

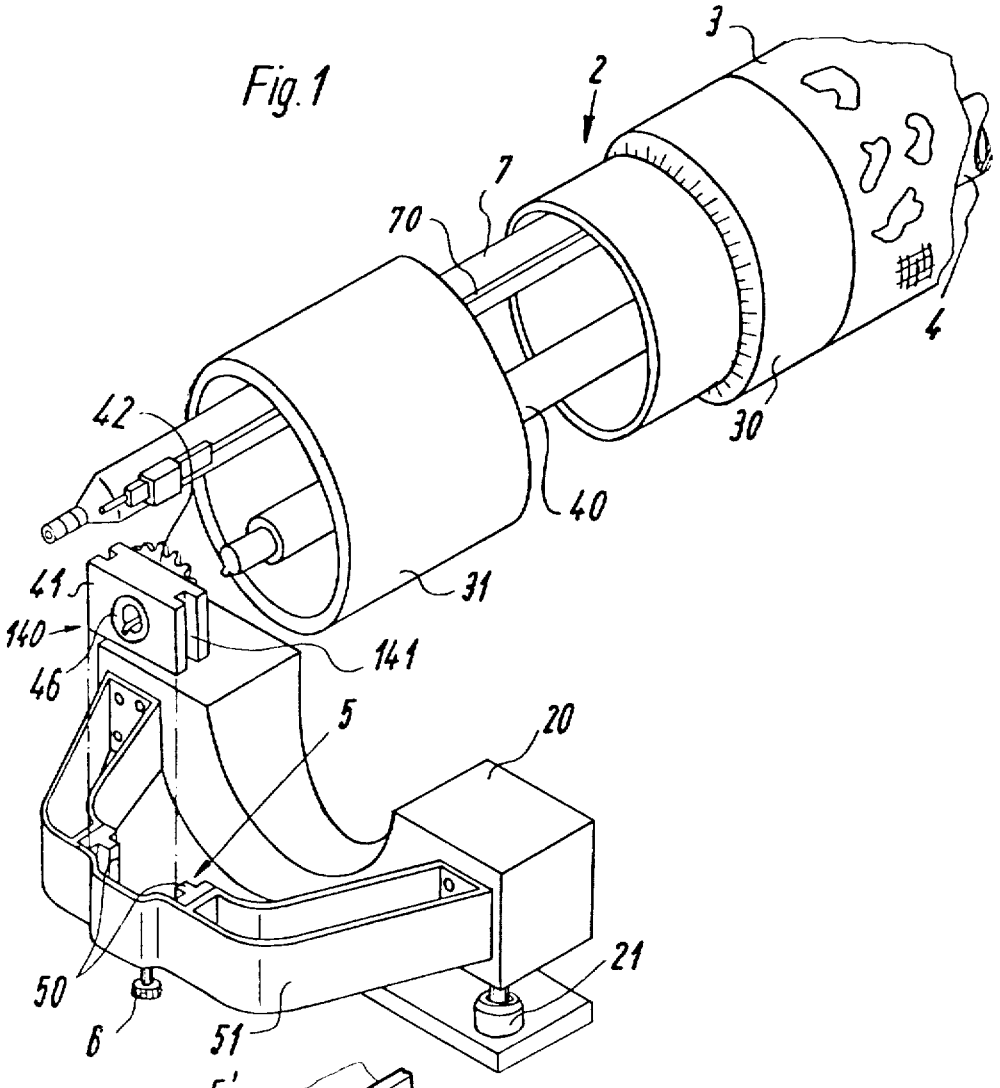
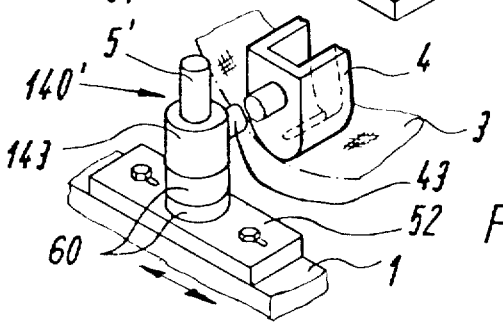
Fig. 2

1
2
3
4
5
5''
6
8
9
10
20
30
40
41
42
46
53
55
140''

1
4
40
46
55
5''''
140''''

4
5
6
30
40
41
46
54
55
140
155

1
4
5'''
6
41
44
45
53
54
55
140'''
155

LATERAL SUPPORT FOR SQUEEGEE

BACKGROUND OF THE INVENTION

The present invention relates to a lateral support for a squeegee of an application mechanism of an application machine, for example having a rotatable stencil, and to an application mechanism of an application machine provided with a lateral support.

Printing mechanisms with squeegee rollers are known in the art. The squeege rollers are arranged inside rotatable stencils, such as in cylinder or band stencils. They also can be arranged on flat-side stencils, which in this case must reciprocate. The squeege roller rests in lateral supports which are generally mounted on lateral heads for supporting the stencil. They also can be arranged on the machine frame. In this event special lateral supports are required for such squeegee rollers. When a non-uniformity takes place in the web to be printed, the squeegee roller itself cannot eliminate this problem and it is necessary to lift the entire printing mechanism, including the lateral head, the stencil, the impression cylinder and its bearing.

Squeegee rollers are also known which are connected with paint supply pipe which in turn is vertically adjustable. In this case, however, the paint supply pipe with its own weight and with the weight of its contents must be lifted so that in the event of a non-uniformity resulting from the web to be printed, this entire weight over the squeege roller must be lifted.

SUMMARY OF THE INVENTION

Accordingly, it is an object of the present invention to provide a lateral support for a squeegee roller of an application mechanism of an application machine which avoids the disadvantages of the prior art.

More particularly, it is an object of the present invention to provide a lateral support for a squeegee of a printing mechanism of a screen (or not) application machine in which the squeegee itself is free at its ends and supports with its own weight on the stencil or sieve and thereby on the webs and applies a uniform pressure onto the web and the squeegee in the event of pressure non-uniformity can be displaced upwardly and removed from the machine during stencil exchange with the squeegee which is free of play in vertical direction and can be held in some cases with the aid of a depth limiting means.

In keeping with these objects and with others which will become apparent hereinafter, one feature of the present invention resides, briefly stated, in a lateral support for a squeegee of a printing mechanism of a screen application machine which has a supporting element arranged to support one end portion of the squeegee roller, and a substantially upright upwardly open guiding element arranged to slidingly guide the supporting element.

When the lateral support is designed in accordance with the present invention it provides for the following advantageous results. The squeegee roller lies with its own weight, and actually with its effective own weight, on the stencil, and thereby on the web and no additional pressure must be laterally applied. When a pressure non-uniformity takes place, the squeege roller can be lifted from the web exactly in a vertical plane, and it is not necessary, as for example in the event of the bar-shaped loosely lying round squeegee roller to move the same from the impression plane. The squeegee roller can be changed and withdrawn without mounting works, which can be performed by lifting the squeege roller, and even by hand in the case of emergency.

In accordance with another advantageous feature of the present invention, the squeegee roller can be limited from below in a stepless manner, which is important for fine treatment of a nap of a nap web. Simultaneously, the depth limiting can be so adjusted that the entire own weight of the squeege roller lies on the web and guarantees a uniform impression over the entire width of the web.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a perspective view of a lateral support of a squeegee roller formed as an impression cylinder with a lateral head for a stencil;

FIG. 2 is a view showing a lateral support in accordance with another embodiment of the present invention, wherein a squeegee roller is formed as a slotted squeegee roller, with one guiding member;

DESCRIPTION OF PREFERRED EMBODIMENTS

Figure 3:
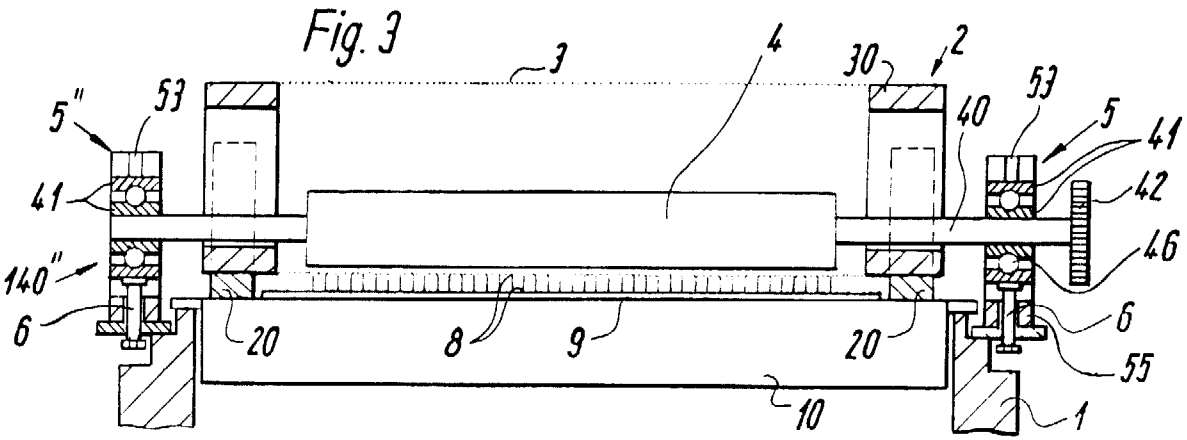
FIGS. 3 and 4 are views showing a lateral support in accordance with a further embodiment of the invention, for a printing mechanism with a cylindrical stencil, with mutually parallel guiding members mounted on a machine frame.

A lateral support of the present invention is utilized for a squeegee of a screen printing machine which is identified by reference numeral 1. One or two printing mechanisms 2 can be arranged in the screen printing machine 1. The printing mechanisms 2 operate advantageously with a rotatable stencil 3. The drawings show cylinder stencils which are formed as round stencils. The inventive lateral support can be also be utilized for band stencils which are guided via several rollers. It can also be utilized for flat-side stencils when the squeegee is guided over the stencil in a known manner.

The lateral support shown in FIG. 1 is utilized for the round cylindrical stencil 3 which has at its both ends end rings 30 of which only one is shown in the drawing. A stencil material is mounted on the end rings 30. The end ring 30 is connected in a known manner with a support ring 31, for example by not shown pins, bayonet locks and the like. The supporting ring 31 lies in a respectively designed lateral head 20. In the shown example, the support ring 31 is received in the lateral head 20 in an open bearing part.

A squeegee roller 4 is located in the interior of the stencil 3. The squeegee roller 4 is formed as an impression cylinder and its both ends are supported in rotatable manner. The squeegee roller 4 extends with its axial ends 40 outwardly beyond the interior of the stencil 3 and passes additionally through the support rings 31. In the embodiment shown in FIG. 1 the axial ends 40 of the squeegee roller are supported in a lateral supporting element 140. The lateral supporting element 140 is composed, for example, of a supporting block 41 which is slidingly guided in an upwardly open double guiding element 5. The supporting element 140 and the guiding element 5 cooperate with one another.

The stencil 3 in this embodiment with its support ring 31 is supported in an upwardly open lateral head 20. FIG. 1 shows an exploded perspective view of only one side of the lateral support, whereas the opposite side is designed in an identical way.

The guiding element 5 is provided with a projection 50 engaging in a groove of a supporting block 41. A depth limiting element 6 is provided for limiting the depth of movement of the support block 41 or the supporting element 140. The depth limiting element 6 is formed, for example, as a screw which limits in a stepless manner the deepest position of the supporting block 41 in the guiding element 5.

The axial ends 40 of the squeegee roller 4 lie in the supporting block 41 in a bearing 46, advantageously roller bearing or ball bearing. The bearing 46 can be connected with a drive gear 42 for the squeegee roller 4 formed as an impression cylinder. Thereby, the squeegee roller with its own weight can reliably lie on a not-shown web in the interior of the stencil, with interposition of the stencil 3 which is not essential to the physical pressure application. No additional pressure onto the lateral supporting element 140 is to be supplied in order to guarantee unobjectionable placing of the squeegee roller formed as an impression cylinder. Physical pressure on the lateral supporting element results in the fact that frequently very long impression rollers are lifted centrally from the stencil and the web, whereas laterally the web, particularly in the event of treating a high nap carpet web is pressed, and thereby non-uniform printing is produced. In the event of upward adjustment of the lateral support of the squeegee roller 4, particularly the impression roller, it can be obtained that the squeegee roller 4 sags centrally and applies a higher pressure onto the stencil and the web in the central region and no unobjectionable printing medium application takes place laterally. The adjustment provided by the adjusting members 6, for example by the screw, can adjust the deepest point for the application of the squeegee roller 4, so that the above-mentioned disadvantages can be eliminated.

When a non-uniformity occurs, the squeegee roller 4 is lifted itself and, however, takes with it the supporting element 140 or the relatively small supporting block 41 which does not act in any way upon other parts of the interior of the stencil.

The embodiment shown in FIG. 1 has a further advantage in the fact that the guiding element or the guiding elements 5 are mounted on the lateral head 20 of the printing mechanism. Thus, with repeated adjustment of the printing mechanism 2 at an angle to the passage direction of the guiding elements and thereby the supporting elements 140, this adjustment can automatically be performed.

For simple mounting of the guiding elements 5 on the lateral heads 20, the guiding elements 5 are received in a holding element 51 which can be adjustably mounted on the lateral head 20 or formed as the latter. The holding element 51 is U-shaped. During upward adjustment of the lateral head 20, the squeegee roller 4 is also automatically lifted.

Other parts which also extend through the rotary stencil 3 such as a printing medium pipe 7 and a height monitoring device 70 for the printing medium level in printing medium wedge in front of the squeegee roller 4 formed as an impression cylinder, extend through the support ring 31 and the stencil 3. The entire unit can be removed without complicated mounting works by lifting and withdrawing the stencil 3 with the support ring 31 and withdrawing the squeegee roller 4 with its supporting elements 140 from the guiding element 5. This is especially simple when the lateral head 20 forms an open support for the stencil in the known way. It is to be understood that this is true at both sides.

FIG. 2 shows a simplified embodiment of the present invention in which one guiding element 5' is arranged at each side of the arrangement formed as a simple round bar. Only one supporting area is shown in the drawing. The guiding element 5' rests on a plate 52 which is adjustable on the machine frame so that to provide an accurate adjustment for the squeegee roller 4 which is formed in both embodiments as a slotted squeegee roller. The stencil 3 is not shown in this embodiment. Lateral heads for the stencil 3 can be arranged between the guiding element 5' and the stencil 3. The guiding element formed as a simple bar can be mounted itself on the lateral head, whereas the squeegee 4 with supporting elements 140' at each side can be mounted on the bar-shaped guiding element 5'. The interengagement on the guiding element 5 is important, particularly when another construction is selected. FIG. 2 shows a simplified example.

In this embodiment, a support pin 43 of the squeegee 4 with a ring 143 embraces the bar-shaped guiding element 5'. Washers 60 can serve as adjustment members. Mounting of the plate 52 can be performed by screws arranged in elongated openings. This makes possible an adjustment in a web running direction.

Figure 4:
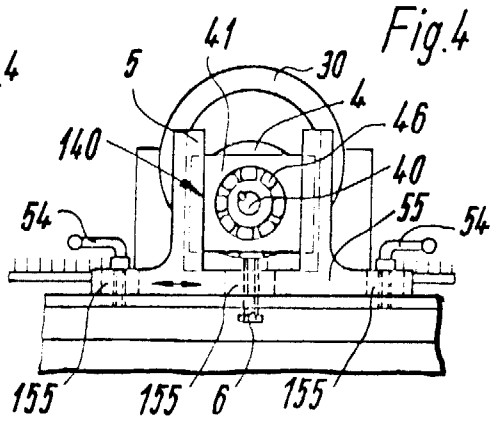

FIGS. 3 and 4 show a further embodiment of the invention. The screen printing machine 1 has a counter pressure beam 10 in the region of the printing mechanism 2, the beam 10 extending from one side of the machine to the other side thereof. The stencil 3 is located with its end rings 30 above the counter-pressure beam 10. The end rings 30 here are also support rings in the lateral heads 20 which can be formed in any manner.

Guiding elements 5'' for supporting elements 140'' of the squeegee roller 4 with supporting blocks 41 are arranged on the machine frame. The supporting blocks 41 engage in grooves 53 of the guiding elements 5. A bearing 46 for an axial end 40 of the squeegee roller 4 is supported in the supporting block 41. The depth of the central axis of the squeegee roller 4 formed as an impression cylinder can be fixed for its deepest position. The deepest position must be adjusted so that some air always remains below the normal printing position.

A web 8 formed as a nap web is shown in FIG. 3 and rests on a printing table 9 which, advantageously is an endlessly running table. It is to be understood that the nap can be remained not pressed particularly in the event of relatively small working widths. The lateral head 20 can also be adjustable in an upward direction which is not, however, shown in this embodiment and is generally known. FIG. 1 shows this adjustment possibility for the lateral head 20 with the aid of an adjustment device 21. There is, however, an important difference whether the entire lateral head is upwardly adjustable or the squeegee roller itself, for a vertical adjustment in lateral regions, is freely guided and limited in its deepest position by the adjusting element 6.

FIG. 4 shows the front view of the embodiment of the FIG. 1. It can be seen from this Figure that a holding element 55 is provided at each side of the arrangement for a guiding element or guiding elements adjustable in direction of the arrow by releasing screws 54 which extend in elongated openings 150 of the respective holding elements 55. The adjusting element 6 for the depth limiting, for example the adjusting screw, lies in a longitudinal opening 155 of the holding element 55. Thereby the adjustment of the squeegee roller 4 in the web running direction can be accurately performed.

Figure 5:
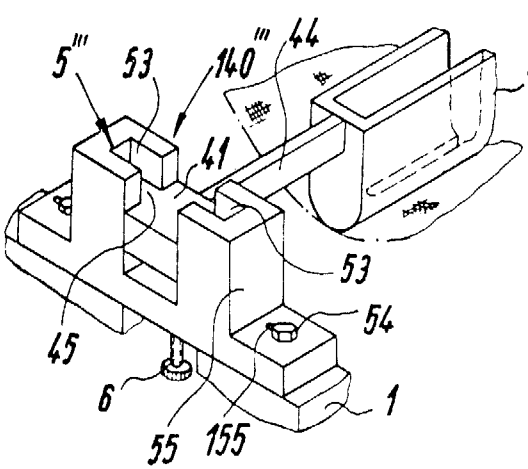
FIG. 5 is a perspective view of a lateral support in accordance with still a further embodiment of the invention for a slotted squeege roller.

FIG. 5 shows a supporting element 140''' for the squeegee roller 4 which is formed as a slotted squeegee roller. Squeegee rollers of any shape can be utilized here. An end arm 44 of the squeegee roller 4 is connected in this embodiment with the supporting block 41 which has a projection 45 at both sides received in the groove 53 of a guiding element 5'''. The latter form two U-shaped guides located opposite to one another. This holding element 55 can also be adjusted inasmuch as mounting screws 54 are arranged in elongated openings 155. The unit is mounted in this embodiment on the machine frame 1.

Figure 6:
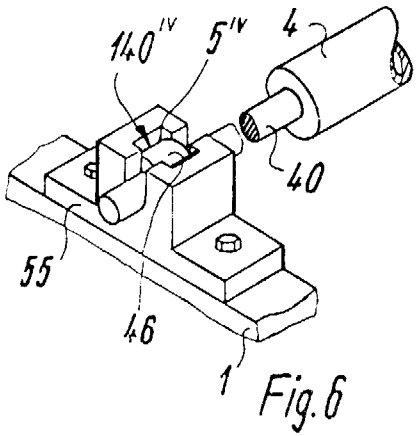
FIG. 6 is a view showing a lateral support with guiding members with an arrangement of a bearing for a squeegee roller formed as an impression cylinder.

In the embodiment shown in FIG. 6, the squeegee roller 4 is illustrated which is also formed as an impression cylinder. The axial ends 40 lie in U-shaped guides formed as guiding elements $5^{IV}$. The bearing 46, such as ball bearing or roller bearing, is supported in the U-shaped guiding element adjustable in a vertical direction. The ball bearing or roller bearing is located here in a known ring or a sleeve and not in a supporting block 41.

The squeegee roller 4 in the present invention, formed as an impression cylinder, is provided with its own rotary drive. The advantages in this case are especially remarkable inasmuch as the impression cylinder can fully lie with its own weight with interposition of the stencil on the web and thereby guarantee a uniform printing medium application which is especially improved by the uniform rotary drive. As shown in the respective embodiments, a slotted squeegee roller of any construction can also be utilized. It is also possible to utilize squeegee rollers into which a printing medium is applied under pressure, or so-called pressure squeegee rollers. Furthermore, pressure loaded rib-shaped squeegee rollers can be utilized. They, however, have the advantage in the fact that during application movement and removal movement, the application line changes because of change of the angle of incidents of the squeegee roller. Further, a loaded strip-shaped squeegee roller which is pressure loaded by a controllable cushion or mechanically can be disregarded. What is actually important is the fact that the lateral supporting element 140—140$^{IV}$ of the squeegee roller 4, and the squeegee roller itself, is guided slidingly in the vertical upwardly open guiding element 5—5$^{IV}$. Both supporting elements are advantageously identical. It is especially advantageous when the squeegee rollers 4 are formed as driven impression cylinders.

As can be seen from the above described embodiments, the basic idea of the invention can be varied. The individual features which are considered to be inventive can be combined with one another. Thus, for example, the horizontally lying U-shaped holding element 51 which is arranged on the respective lateral head 20 can carry any suitable vertically lying guiding element part.

The mechanism in accordance with the invention can be utilized not only for printing it the sense of forming a pattern, but also for application of all liquid, pasty and viscous substances, or the like. Various flat articles can be colored, finished or coated. The stencil must not always be patterned, but it can also be formed as a simple sieve. The machine can also work without a stencil. Then the application-element (perhaps squeegee roller) is lying directly of the web.

It will be understood that each of the elements described above, or two or more together, may also find a useful application in other types of constructions differing from the types described above.

While the invention has been illustrated and described as embodied in a lateral support for a squeegee roller, and a printing mechanism of the screen printing machine provided with such a lateral support, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A lateral support for a squeegee of a printing mechanism of a screen printing machine, comprising at least one supporting element arranged to support each end portion of a squeegee independent of the screen support so that the squeegee lies on an object to be printed solely under its own weight; and at least one substantially upright upwardly open guiding element arranged to slidingly guide each said supporting element for free movement in a substantially upright direction and formed to limit movement of said supporting element downwardly but to allow unlimited movement of said supporting element upwardly so that said supporting element can unobjectionably move upwardly along said guiding element under the action of the object running under the squeegee and solely by the upward movement can even disengage from said guiding element for disassembling purposes, without releasing other structural parts.

2. A lateral support as defined in claim 1, wherein said supporting element and said guiding element are arranged so that said supporting element is slidingly guided in said guiding element.

3. A lateral support as defined in claim 1, wherein said supporting element and said guiding element are arranged so that said supporting element is slidingly guided on said guiding element.

4. A lateral support as defined in claim 1, wherein said supporting element is formed as a bearing, said guiding element being upwardly unlocked and slidingly supporting said bearing.

5. A lateral support as defined in claim 1, wherein the squeegee is formed as an impression cylinder, said supporting element being formed as a bearing for supporting the impression cylinder, said guiding element being upwardly unlocked and slidingly guiding said supporting element.

6. A lateral support as defined in claim 1, wherein said guiding element for guiding said supporting element is formed as upwardly open parallel guide.

7. A lateral support as defined in claim 1, wherein said guiding element for guiding said supporting element is U-shaped.

8. A lateral support as defined in claim 1, wherein said guiding element has two U-shaped guiding portions located opposite to one another.

9. A lateral support as defined in claim 1, wherein said supporting element is formed as a ball bearing, said guiding element being formed as a parallel guide; and further comprising a bearing block arranged between said ball bearing and said parallel guide.

10. A lateral support as defined in claim 9; and further comprising connecting means for a projection-groove-like connection of said guiding element with said bearing block in interengaging but upwardly open manner with slidingly guiding in said guiding element.

11. A lateral support as defined in claim 1, wherein said guiding element slidingly guides said supporting element to a predetermined depth; and further comprising means for limiting the depth of guiding said supporting element in said guiding element.

12. A lateral support as defined in claim 11, wherein said depth limiting means is arranged so that they limit the depth of said supporting element in a stepless manner.

13. A lateral support as defined in claim 11, wherein said depth limiting means includes a depth adjusting member against which said supporting element abuts.

14. A lateral support as defined in claim 11, wherein said depth adjusting member of said depth limiting means is formed as an adjusting screw.

15. A lateral support as defined in claim 1; and further comprising a lateral head for supporting a stencil of a printing mechanism, said supporting element being arranged on said lateral head for supporting the stencil.

16. A lateral support as defined in claim 15, wherein said supporting element is adjustably mounted on said lateral head for supporting the stencil.

17. A lateral support as defined in claim 15, wherein said lateral head carries a holding member, at least one said guiding element for a respective one of said supporting elements being arranged in said holding member.

18. A lateral support as defined in claim 17; and further comprising a depth limiting member for adjusting a working height of said supporting element, said guiding element being arranged on said depth limiting member.

19. A lateral support as defined in claim 17, wherein said holding member is carried by said lateral head is U-shaped.

20. A lateral support as defined in claim 1; and further comprising a machine frame, said guiding element being adjustably mounted on said machine frame in the region of the printing mechanism.

21. A lateral support as defined in claim 1, wherein the squeegee is formed as an impression cylinder, said supporting element being formed as a bearing arranged to support the impression cylinder and slidingly guided in said guiding element.

22. A lateral support as defined in claim 1, wherein said supporting element is formed as a bar-shaped member, said guiding element surrounding said bar-shaped member.

23. A lateral support as defined in claim 22, wherein said bar-shaped member which forms said supporting element is round.

24. A lateral support as defined in claim 22, wherein said guiding element which surrounds said bar-shaped member is formed as a ring.

25. A lateral support as defined in claim 22; and further comprising a depth limiting member for adjusting a working height of said supporting element, said depth limiting member being formed by a plurality of washers.

26. A lateral support as defined in claim 1, and further comprising a lateral head for supporting a cylindrical screen-printing stencil, said supporting element with said guiding element being mounted on said lateral head, and said lateral head being formed as an upwardly open support.

27. A lateral support as defined in claim 1, wherein the squeegee is formed as an impression cylinder and provided with a rotary drive at at least one end thereof, said supporting member being arranged to support also the rotary drive of the impression cylinder.

28. A lateral support as defined in claim 1, wherein the squeegee is formed as a slotted squeegee roller, said supporting element being arranged to support the slotted squeegee roller.

29. A printing mechanism of a rotary screen printing machine, comprising a stencil; a squeegee inside said stencil; and a lateral support for said squeegee so that the squeegee lies on an object to be printed solely under own weight of said squeegee and including at least one supporting element arranged to support each end portion of said squeegee, and at least one substantially upright upwardly open guiding element independent of the support arranged to slidingly guide each said supporting element for free movement in a substantially upright direction and formed to limit movement of said supporting element downwardly but to allow unlimited movement of said supporting element upwardly so that said supporting element can unobjectionably move upwardly along said guiding element under the action of the object running under the squeegee and solely by the upwardly movement even disengage from the latter for disassembling purposes, without releasing other structural parts.

* * * * *